US005421977A

United States Patent [19]

Getsy et al.

[11] Patent Number: 5,421,977

[45] Date of Patent: Jun. 6, 1995

[54] FILTER PRESS ELECTROLYZER

[75] Inventors: Andy W. Getsy, Eastlake; Marilyn J. Niksa, Concord, both of Ohio

[73] Assignee: ELTECH Systems Corporation, Chardon, Ohio

[21] Appl. No.: 93,606

[22] Filed: Jun. 30, 1993

[51] Int. Cl.[6] ..... C25B 9/00

[52] U.S. Cl. ..... 204/263; 204/252; 204/279

[58] Field of Search ..... 204/252, 279, 282, 283, 204/296, 263

[56] References Cited

U.S. PATENT DOCUMENTS

| | | | |
|---|---|---|---|
| 4,056,458 | 11/1977 | Pohto et al. | 204/263 |
| 4,149,951 | 4/1979 | Eddleman | 204/253 |
| 4,312,737 | 1/1982 | Kircher | 204/257 |
| 4,396,689 | 8/1983 | Grimes et al. | 204/296 |
| 4,517,069 | 5/1985 | Harney et al. | 204/290 |
| 4,654,136 | 3/1987 | Dang et al. | 204/283 |
| 4,738,763 | 4/1988 | Abrahamson et al. | 204/252 |
| 4,923,582 | 5/1990 | Abrahamson et al. | 204/255 |
| 5,041,196 | 8/1991 | Cawlfield et al. | 204/101 |

*Primary Examiner*—Kathryn Gorgos
*Attorney, Agent, or Firm*—John J. Freer; David J. Skrabec

[57] ABSTRACT

The present invention relates to a filter press electrolyzer of the type having front and rear bulkheads. The electrolyzer comprises an electrolytic cell between the bulkheads. The cell comprises a pair of planar electrode assemblies, typically including a center compartment assembly therebetween, all in a stacked relationship. Separators are clamped between the electrode and center compartment assemblies. Each electrode assembly comprises an annular frame defining an electrolyte chamber, a planar electrode member having an electrode active area within said chamber, and a current distributing bus on the side of the electrode member which is opposite the side facing the separator. The current distributing bus has a planar surface area which is substantially co-extensive with the electrode active area. Each of the electrode assemblies comprises a plurality of spaced-apart separator strips affixed to the electrode member on the side opposite the current distributing bus. The separator strips separate the electrode member from the separator. The bulkheads include means for compression of the electrode assemblies one against the other. The separator strips of the electrode assemblies are aligned so that the separator strips transmit the compression forces within the electrolyzer from one electrode assembly to the other.

39 Claims, 6 Drawing Sheets

FILTER PRESS ELECTROLYZER

BACKGROUND OF THE INVENTION

1. Technical Field

The present invention relates to a filter press electrolyzer. The electrolyzer comprises an electrolytic cell in which separators are clamped between filter press frames.

The present invention will usually be described with reference to a three-compartment electrolytic cell, although it will be understood by those skilled in the art that the present invention also has applicability to a two-compartment cell.

2. Description of the Prior Art

It has been known to produce electrolytic cells having electrode assemblies in sandwiched relationship, which can include membranes therebetween to form a closed cell. Such assemblies arranged in filter press fashion have been taught for example in U.S. Pat. No. 4,056,458.

It has also been known that for filter press electrolyzers the electrodes can be prepared in a frame orientation. For example, in U.S. Pat. No. 4,312,737, a frame having two sides with a chamber therebetween, which chamber is formed between foraminous surfaces, is taught as useful as an electrode for a filter press cell. Conductor rods are utilized within the chamber between the foraminous surfaces.

U.S. Pat. No. 4,738,763, assigned to the assignee of the present application, discloses a filter press electrolyzer. The electrolyzer has an electrolytic cell which comprises an anode assembly and a cathode assembly in a stacked relationship between bulkheads of the electrolyzer. The cathode assembly has a cathode pan and a cathode active area. The anode assembly has an anode pan and an anode active area. Current distributors are provided to convey current to and from the cathode and anode active areas. The current distributors have planar surface areas which have substantially the same peripheral dimensions as the cathode and anode active areas. The cathode active area and the anode active area are separated from each other by a membrane. Spring means, preferably integral with the anode active area, maintain the cathode assembly and the anode assembly in a compressed state against each other, between the bulkheads, providing the cell with a zero or finite gap.

The '763 patent discloses a two-compartment filter press electrolytic cell. However, the principles of the patent are also applicable to a three-compartment filter press electrolytic cell.

It has also been known to interpose between a foraminous electrode component and an electric current transmission element, a metal liner. Such configuration for electrochemical cells has been disclosed in U.S. Pat. No. 4,654,136. The transmission element can have a plurality of projecting bosses and the liner can have a profile matching the face of the element. However, the configuration of both the transmission element and the metal liner tend to be somewhat complex.

SUMMARY OF THE INVENTION

The present invention relates to a filter press electrolyzer, and generally to the type having front and rear bulkheads. The electrolyzer of this type comprises an electrolytic cell between the bulkheads. The electrolytic cell comprises a pair of planar electrode assemblies, in a stacked relationship with each other. Each electrode assembly comprises an annular frame defining an electrolyte compartment. A separator is clamped between the electrode assembly frames. Each electrode assembly also comprises a planar electrode member. Each planar electrode member is a combination of a foraminous metal electrode having an active area on at least one side and a metal backplate which is attached to the foraminous plate on one side. A plurality of parallel spaced-apart metal compression ribs separate the foraminous metal plate from the backplate. The metal compression ribs are secured to both the foraminous metal plate and the backplate, and establish the area of the electrolyte compartment which is between the backplate and the foraminous metal plate.

A current distributing bus is positioned against the metal backplate. The current distributing bus has a planar surface area which is in most respects co-extensive with the electrode active area. Each of the electrode assemblies comprises a plurality of resilient spaced-apart separator strips which are affixed to the foraminous metal electrode on the side opposite that which is adjacent to the electrolyte compartment. The separator strips separate the foraminous metal electrode from the adjacent separator. The bulkheads include means for applying a compression load onto the electrode assemblies where at least some of the compression ribs, preferably every other one, are aligned with the separator strips. These aligned ribs assist in the transmission of the compression load within the electrolyzer from one electrode assembly to the other.

In this construction when electrolyzer compression forces are released, each electrode assembly can be removed as a unit from the electrolyzer. Also, the electrode assembly frame can be separated from the balance of the assembly. Where separator strips are releasably secured, they can be detached. The remaining assembly of electrode, backplate and compression ribs can then be individually serviced, e.g., as in recoating of the electrode.

A preferred foraminous metal electrode is one made of an expanded metal.

A preferred backplate is a thin metal plate of a material, such as titanium or stainless steel, which is resistant to the corrosiveness of the electrolyte. The electrode bus is of an electrically conductive material such as copper. The purpose of the compression ribs and separator strips is to maintain desirable contact of the electrode bus with the electrode backplate, by assisting in transmitting compressive forces within the cell, and provide a low resistance electrical path in the electrolyzer.

In an embodiment of the present invention, the electrolyzer is in the form of a three-compartment cell. The cell includes a center compartment assembly between and in stacked relationship with the electrode assemblies. The center compartment assembly includes an annular frame defining an electrolyte chamber. The center compartment assembly includes ribs within the electrolyte chamber which are aligned with the aligned ribs of the pair of electrode assemblies. The center compartment ribs transmit the compression load from one electrode assembly to the other.

In the three-compartment cell, one of said electrode assemblies is a cathode assembly. The frame of the cathode assembly and cathode electrode member components define a catholyte chamber. The other of said electrode assemblies is an anode assembly. The frame of the anode assembly and anode electrode member components define an anolyte chamber. The electrolyzer includes means for circulating Catholyte within the catholyte chamber, means for circulating anolyte within the anolyte chamber, and means for circulating electrolyte within the center compartment electrolyte chamber.

In this three-compartment cell embodiment, the electrolyzer comprises a first separator which is clamped between the frame of the cathode assembly and the frame of the center compartment assembly, and a second separator clamped between the frame of the anode assembly and the frame of the center compartment assembly. The separators can be a membrane or diaphragm.

Preferably, each of the bulkheads comprises a deformable planar member and means to exert a force on said deformable planar member to force it into a configuration that is slightly concave toward the center of the electrolyzer. In such configuration, the deformable member exerts a compressive force on the electrode assemblies.

Preferably, each bulkhead is a dual bulkhead assembly including inner and outer bulkhead members. The inner bulkhead member is said deformable planar member and is adjacent an electrode assembly. The outer bulkhead member is relatively rigid. Each bulkhead assembly includes adjustable means between the bulkhead members to force the inner bulkhead member into said concave configuration.

BRIEF DESCRIPTION OF THE DRAWINGS

The present invention and advantages thereof will become further apparent upon consideration of the following specification with reference to the accompanying drawings, in which.

DESCRIPTION OF PREFERRED EMBODIMENTS

The electrolyzers of the present invention can be useful, particularly in an embodiment containing a two compartment cell, for use as a chlor-alkali cell. As three-compartment cells, the invention electrolyzers are particularly useful for the electrolysis of salt solutions, such as sodium chlorate and sodium sulfate, to regenerate acid and base values. These can include operation on waste streams, e.g., the electrolysis of a waste sulfate stream. Further in regard to this aspect of the invention, the discussion hereinbelow will be initiated by reference to a three-compartment, filter press electrolyzer.

Figures 1A, 5:
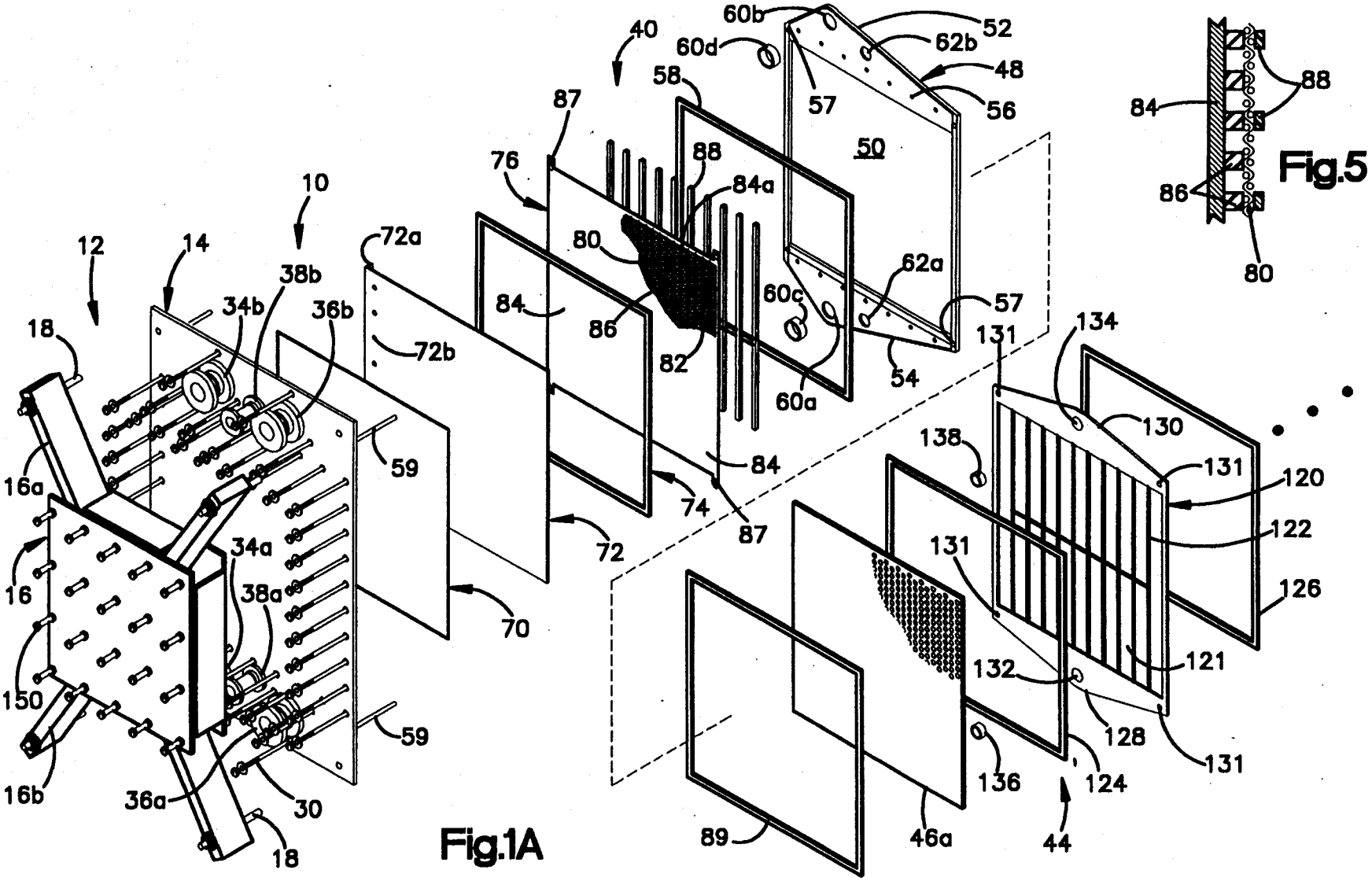
FIG. 1A is an exploded perspective view of a portion of an electrolyzer in accordance with the present invention, showing a cathode assembly and center compartment assembly of a monopolar three-compartment electrolytic cell.
FIG. 5 is an enlarged partial plan view showing compression ribs and related structure of the cathode assembly of FIG. 1A.

Referring to FIG. 1A, a filter press electrolyzer 10 representative of the present invention comprises a feed/discharge, or front, bulkhead 12. The feed/discharge bulkhead 12 is a dual bulkhead assembly comprising an inner plate 14, which is deformable into a slightly concave configuration toward, or as viewed from, the center of the electrolyzer 10, and an outer rigid compression frame 16. The compression frame 16 has outstretched arms **16*a* and legs 16*b*. The arms 16*a* and legs 16*b* are aligned with the inner plate 14, at the corners of the inner plate 14, by tension rods 18**.

Figures 1B, 6:
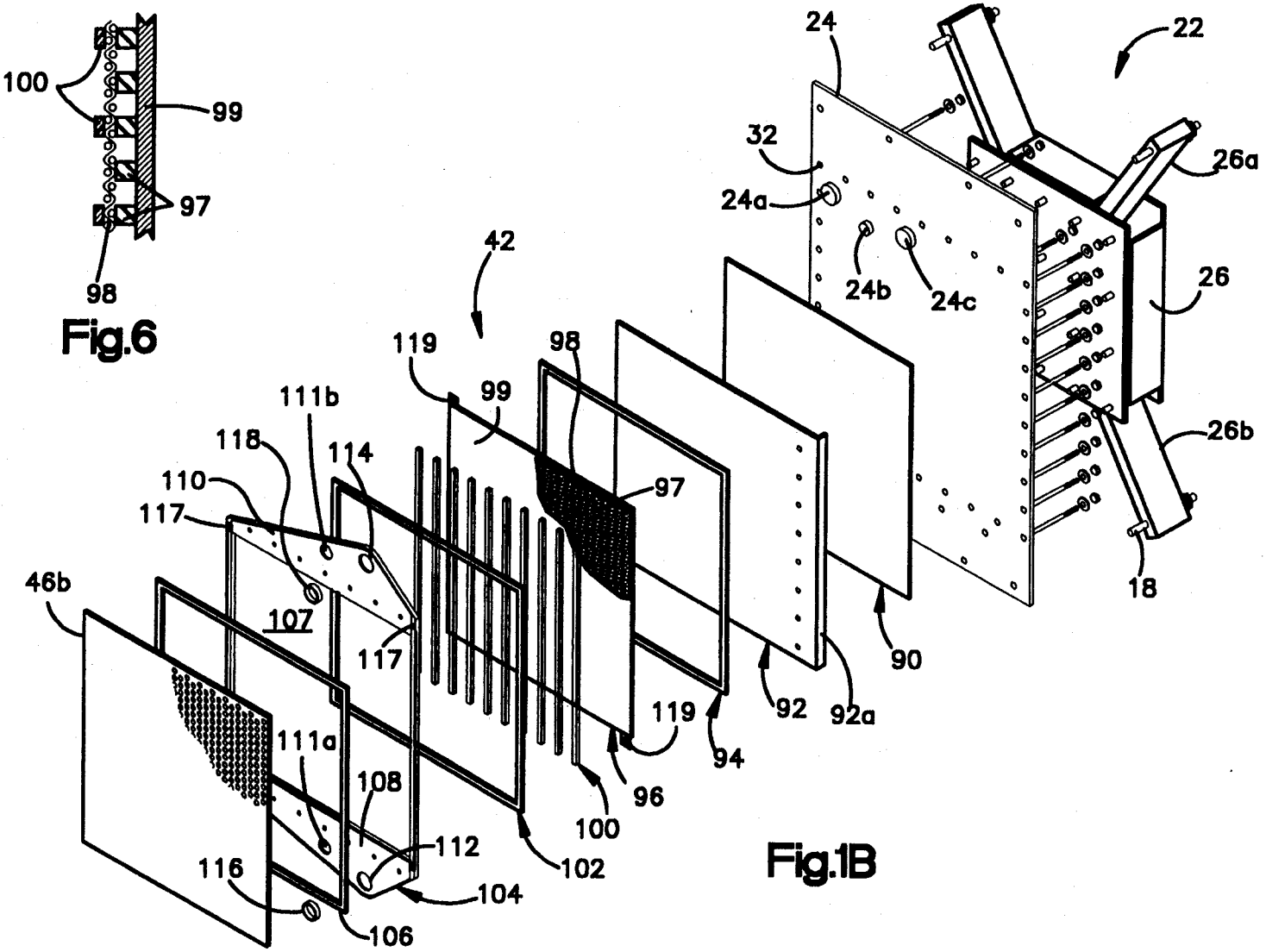
FIG. 1B is an exploded perspective view of the remaining portion of the electrolyzer of FIG. 1A, showing an anode assembly of the monopolar three-compartment electrolytic cell.
FIG. 6 is an enlarged partial plan view showing compression ribs and related structure of the anode assembly of FIG. 1B.

The electrolyzer also comprises a rear bulkhead 22 (FIG. 1B). The rear bulkhead 22 also is a dual bulkhead assembly having an inner, deformable, typically steel, plate 24. The inner plate 24 is deformable into a non-planar configuration that is slightly concave toward, or as viewed from, the center of the electrolyzer 10. The inner plate 24 is aligned by openings 32 to a rear bulkhead compression frame 26. The rear compression frame 26 has outstretched arms **26*a* and legs 26*b* which are aligned with the inner plate 24, at the opposed corners of the inner plate 24, by the rods 18 extending from the feed/discharge bulkhead 12**.

As shown in FIGS. 1A and 1B, the electrolyzer 10 has around its periphery an array of closely spaced adjustable compression means, e.g., tie rods 30, best shown in FIG. 1A. The tie rods 30 penetrate aligned openings 32, best shown in FIG. 1B, in the inner plates 14 and 24 of the front and rear bulkheads. At the sides of the plates 14 and 24 there are typically one set of openings 32 positioned at the periphery of the plates 14 and 24. At the top and bottom of the plates 14 and 24, there are typically two sets of openings 32, one set at the periphery of the plates 14 and 24, as well as one set placed somewhat inwardly from the upper and lower edges of the plates 14 and 24. The outer set, or edge, openings 32 serve to enhance sealing, such as of gaskets for feed and discharge ports located toward the upper and lower edges of the plates 14 and 24, while the inner set of openings 32 are to assist in sealing of the more interior cell gaskets. These are the gaskets usually for the electrode assemblies, which gaskets are generally spaced inwardly in location, from the plate periphery. As will be described hereinbelow, the tie rods 30 are in tension when the electrolyzer is assembled pulling one bulkhead assembly towards the other.

The feed/discharge bulkhead 12, FIG. 1A, also has, connected to the inner plate 14, contiguous with the lower edge of the plate 14, a catholyte feed port **34*a*, an anolyte feed port 36*a*, and a center compartment feed port 38*a*. The plate 14 has, contiguous with the upper edge of the plate, a catholyte discharge port 34*b*, an anolyte discharge port 36*b*, and a center compartment discharge port 38*b***.

Between the feed/discharge bulkhead 12 and the rear bulkhead 22, the electrolyzer 10 comprises a cathode assembly 40 (FIG. 1A) and an anode assembly 42 (FIG. 1B). The cathode assembly 40 and the anode assembly 42 are separated from each other by a center compartment assembly 44 (FIG. 1A), which, with the cathode assembly 40 and anode assembly 42, makes up a three-compartment electrolytic cell. This or similar arrangements of assemblies is sometimes referred to herein for convenience as a "cell stack" or simply a "stack".

For the representative electrolyzer 10 depicted in these FIGS. 1A and 1B, the cathode assembly 40 is contiguous with the feed/discharge bulkhead 12 and the anode assembly 42 is contiguous with the rear bulkhead 22. The center compartment assembly 44 is separated from the cathode assembly by a first separator **46*a* (FIG. 1A). The anode assembly 42 (FIG. 1B) is separated from the center compartment assembly 44 by a second separator 46*b* (FIG. 1B). The separators 46*a* and 46*b*** can be either a membrane or a diaphragm.

The cathode assembly 40 (FIG. 1A) comprises a generally rectangular cathode frame 48. The cathode frame 48 defines a catholyte chamber 50. The cathode frame 48 has a discharge, or top, manifold 52 and a feed, or bottom, manifold 54. The manifolds 52 and 54 have spaced apart small holes 56 which align with and receive the tie rods 30 which extend between the bulkheads.

The cathode frame 48 also has, adjacent the four corners of the frame, holes 57. These holes receive shear pins 59. The shear pins 59 are slip fitted through holes (not shown) on the inside surface of the inner plate 14 of the feed/discharge bulkhead assembly 12, and extend between the inner plate 14 and the inner plate 24 of the rear bulkhead assembly. The shear pins are made of a non-conductive material, such as a polymeric material, e.g., polyvinylidene fluoride marketed by Pennwalt Corp. under the trademark KYNAR. They typically have small diameter, e.g., a diameter of on the order of about 0.3 to about 0.5 inch. The shear pins support the cathode frame 48 and other components, as will be described hereinbelow.

The cathode frame 48 may be made by machining the frame, such as from a metal plate of generally rectangular configuration. Representative metals for the metal frame 48 are stainless steel or nickel. It is also contemplated that the frame 48 may be made from a plastic which has the appropriate strength and is chemically stable to the catholyte confined by the frame 48. The manifolds 52 and 54 are in secure connection with upright side frame members to complete the frame 48.

The bottom manifold 54 has a port **60*a* which aligns with the catholyte feed port 34*a* of the front bulkhead plate 14. The manifold port 60*a* communicates through a spool 60*c* with the feed port 34*a*. The top manifold 52 also has a port 60*b* which aligns with the catholyte discharge port 34*b*. The manifold port 60*b* communicates with discharge port 34*b* through a spool 60*d*. Both the discharge and feed manifolds 52 and 54 are formed, as by machining from a metal, to provide a plenum chamber (FIG. 7) in each manifold which communicates with a manifold port 60*a* and 60*b*, and has passageways leading from the plenum chambers to the catholyte chamber 50. In this way, catholyte is circulated into and out of the catholyte chamber 50**.

The feed manifold 54 has a second opening **62*a* which, in the view of FIG. 1A, is to the right of manifold port 60*a*. The discharge manifold 52 has a second opening 62*b* which is to the right of the manifold port 60*b*. These second openings 62*a*, 62*b* align with the electrolyte feed and discharge ports 38*a* and 38*b* of the feed/discharge bulkhead 12, through spools 136 and 138 shown with the center compartment assembly (FIG. 1A). The spools 136 and 138 actually extend through the manifolds 54, 52 and are accommodated by the second openings 62*a*, 62*b*. In a manner to be described, the spools 136, 138 circulate electrolyte into and out of the center compartment assembly 44, bypassing the cathode assembly 40**.

The cathode assembly 40 also comprises, from front to rear, an insulator 70, a cathode distributor bus 72, a gasket 74, a cathode subassembly 76, and frame sealing gaskets 58 and 89. The cathode subassembly 76 overall has a generally planar form and fits generally within the boundaries of the catholyte chamber 50, but need not be fastened to, the cathode frame 48. The cathode subassembly 76 includes a conductive metal plate cathode 80 in FIG. 1A, which metal plate has a generally planar form. Only a portion of the metal plate cathode 80 is visible, the remainder, in the view of FIG. 1A, being obscured by a backplate 84 between the metal plate cathode 80 and the cathode distributor bus 72. The metal plate cathode 80 is visible in the cut-away area 82 of the backplate 84. The plate cathode 80 (as well as the plate anode 98 to be discussed later on hereinafter) will usually be foraminous, as further described hereinbelow. However, it is to be understood that plate cathodes and anodes which are not foraminous, i.e., solid plate cathodes, are contemplated. For convenience though, the cathode, as well as the anode, may be referred to herein as the "foraminous metal plate cathode", or anode, as the case may be.

The metal plate cathode 80, sometimes referred to herein simply as the "foraminous metal plate 80", can be any electrically conductive metal resistant to attack by the catholyte in the cell. Steel and stainless steel are preferred, although nickel and valve metals such as titanium may be utilized. A preferred foraminous conductive metal plate cathode 80 is an expanded metal. By way of example, the expanded metal can by in typical electrode mesh form, with each diamond of mesh having an aperture of about one-eighth inch to one-quarter inch or more dimension for the short way of the design, while generally being about one-quarter to about one-half inch across for the long way of the design. These expanded mesh form cathodes can provide good current distribution and gas release.

The cathode distributor bus 72 is made of an electrically conductive material. A preferred material is copper. Aluminum may also be used. The backplate 84 is typically a thin plate which, as with the foraminous metal plate cathode 80, is resistant to attack by the catholyte in the cell. By way of example, the backplate 84 may have a thickness of about 0.02 to 0.03 inch. Metals that can be used for the backplate 84 are valve metals such as titanium as well as other metals including stainless steel and nickel. The foraminous metal plate cathode 80 has an active surface. It is to be understood that by having an "active" surface as the word is used herein in reference to an electrode, it is the surface exposed to electrolyte at which an electrochemical reaction occurs. Since the electrode may be foraminous, activity may take place over an electrode area, not just on a single surface, as will be understood. Thus, sometimes reference will be made herein to an electrode "active area" which term is used interchangeably for "active surface". In the figure, it is the surface of the foraminous metal plate 80 which is not visible in the view of FIG. 1A, that is, which is on the side opposite to that facing the backplate 84.

As shown in FIGS. 1A and 5, with FIG. 5 being a plan view of a portion of the cathode structure, a plurality of vertically extending spaced-apart, parallel, standoff, or compression, ribs 86 are positioned between the backplate 84 and the foraminous metal plate cathode 80. These compression ribs are typically narrow, elongate members. This grouping of compression ribs 86, backplate 84 and foraminous metal plate cathode 80 make up the cathode subassembly 76. The compression ribs 86 are preferably of metal, such as steel or stainless steel, and are firmly fastened, as by welding, to the backplate 84, and then the foraminous metal plate; cathode 80 is firmly fastened, such as welded, onto the ribs 86. It is to be understood that the "compression ribs 86" need not themselves be compressed, but nevertheless at least some of these ribs serve in transmitting compression force through the cell stack. The ribs 86 usually have thin dimensions, for instance, about one-quarter inch width by about one-quarter inch thickness. The thickness of the compression ribs 86 establishes in part the volume of the catholyte chamber, between the backplate 84 and foraminous metal plate 80, into which catholyte is circulated. The compression ribs 86 are spaced apart one from the other, typically be a spacing of about 2–3 inches. This spacing between the compression ribs 86 can vary depending upon the strength of the foraminous metal plate 80. The compression ribs 86 provide mechanical support and electrical current distribution for the foraminous metal plate 80 as well as defining the spacing between the foraminous metal plate 80 and the backplate 84.

Resilient separator strips 88 (see FIGS. 1A and 5) are placed on the surface of the foraminous metal plate 80 on the side facing the separator 46*a*. The separator strips 88 are typically long and narrow elements which generally align with the compression ribs 86, preferably for economy aligning with every other one of the compression ribs 86. These separator strips 88 usually also extend the complete length of a compression rib 86, although other configurations are contemplated. The compression ribs 86 which have no separator strips 88 aligned with them serve to distribute electricity evenly to the foraminous metal plate 80. The resilient material of the separator strips 88 will typically be any polymeric, electrically non-conductive material which is compatible with the catholyte and which is capable of withstanding the compressive forces, without deleterious deformation, that are transmitted through the cell stack. Preferred plastic materials are fluorinated polymers such as the polytetrafluoroethylene marketed as Teflon (Trademark, E. I. DuPont) and the fluorinated polymer Kynar. The resilient separator strips 88 can be releasably held in place, e.g., by adhesive or plastic rivets (not shown), to the foraminous metal plate 80. The compression ribs 86 which are aligned with the separator strips 88 transmit bulkhead forces in the stack, in a manner also to be described. This insures good electrical contact of components within the electrolyzer, principally the cathode distributor bus 72 with the metal backplate 84. Use of the separator strips 88 reduces the potential of damage to the separator 46*a*, or shorts, due to direct compression of the foraminous metal plate 80 onto the separator 46*a*. The resilient separator strips 88 are usually quite thin, for instance, on the order of one-tenth or less the thickness of the ribs 86, most usually being about 0.02 inch in thickness. They may be as wide as the ribs 86, as has been shown in FIG. 5, e.g., on the order of one-quarter inch wide, although separator strips 88 of width larger or smaller than the width of the ribs 86 are also contemplated.

The backplate 84 is a solid metal plate, and serves the function as mentioned of sealing one side of the catholyte compartment 50. The peripheral dimensions of the backplate 84 are slightly more than the peripheral dimensions of the foraminous metal plate 80. There is provided at this periphery of the backplate 84 a continuous, smooth-surfaced annular rim (not shown) which circumscribes the foraminous metal plate 80 and compression ribs 86. The gasket 58 seats between this rim and a cooperating surface of the cathode frame 48 sealing this side of the frame 48. The gasket 58 is typically thinner than the thickness of the compression ribs 86, which are thus partly circumscribed by the cathode frame 48.

The backplate 84 has, at its four corners, holes 87. These holes align with holes 57 of the cathode frame 48, and, as with the holes 57, accommodate the shear pins 59. The shear pins 59 thus support both the cathode frame 48 and the cathode assembly 76. Since the cathode frame 48 and the cathode assembly 76 are both supported on the shear pins 59, the frame 48 and assembly 76 do not need to be fastened to each other. Thus, in disassembly of the electrolyzer for example, the assembly 76 can be easily removed from the frame 48 since they need be held together only by the compression forces transmitted through the electrolyzer.

The cathode distributor bus 72, excepting for a flange 72*a*, which will be more particularly discussed hereinbelow, has essentially the same height and width dimensions as the active surface of the foraminous metal plate 80 and also of the backplate 84. The bus 72 will have at its four corners, holes, not shown, which align with the corner holes 57 of the cathode frame 48, and accommodate the shear pins 59. The shear pins 59 thus also support the bus 72. In the representative three-compartment cell, which is depicted in FIG. 1A, the cathode distributor bus 72 lies firmly up against the bulkhead insulator 70, which in turn lies firmly up against the bulkhead inner plate 14. The insulator 70 insulates the distributor bus 72 from bulkhead 12. The cathode distributor bus 72 also, under the compression forces within the electrolyzer to be described hereinbelow, lies firmly against the backplate 84. In this way, current is distributed uniformly between the cathode 76 and the cathode distributor bus 72.

The gasket 74 seats between the annular rim of the backplate 84, on the side opposite to that accommodating gasket 58, and the cathode distributor bus 72. This seals the cathode distributor bus 72 from the environment. The gasket 74 is very thin. For instance, it may have a thickness of only about 0.005 inch, when compressed, and a width of about one-half inch. This thickness of the gasket 74 permits the distributor bus 72 to be compressed into contact with the backplate 84 over most of the adjacent surface area of these two components.

The cathode distributor bus 72 has a flange 72*a*, along the left side of the bus in the view shown in FIG. 1A. The flange 72*a* extends beyond the gasket 74. As shown in FIG. 1A, the cathode distributor bus 72 has holes 72*b* along the left edge of the bus 72 near the flange 72*a*. The holes 72*b* align with tie rods 30 and accommodate the tie rods. The flange 72*a* has an outer surface which can be electrically attached to a current source (not shown) for the electrolyzer. Preferably, the gasket 74 has dimensions, peripherally, so that it seats about three-quarters inch within the perimeter of the distributor bus 72, except along the lefthand edge where it seats about one-half inch inwardly away from the holes 72*b*.

Completing the cathode assembly 40 is a gasket 89, similar to gasket 58. The gasket 89 seats against the back side of the cathode frame 48, in the view shown in FIG. 1A.

The gaskets 74, 58 and 89 of the electrode assembly can be of any material compatible with the catholyte. A preferred gasket material for these as well as typically any gasket utilized herein is a material manufactured from polytetrafluoroethylene (PTFE) and marketed by W. L. Gore & Associates, Inc. under the trademark Gore-Tex. The gaskets 58 and 89 should, as with gasket 74, be thin to reduce ohmic losses, but generally are not as thin as the gasket 74. Moreover, the gaskets 58 and 89 can be as wide as the gasket 74. By way of example, the gaskets 58 and 89 can have a width of about three-quarters inch and a thickness of about 0.05 inch when compressed. For insulation, e.g., the insulation 70, suitable useful materials include PVC, CPVC and polypropylene.

Because of its similarity to the cathode assembly 40, the anode assembly 42 (FIGS. 1B, and 6) will be next discussed. It is essentially the mirror image of the cathode assembly 40, and is similar in construction to the cathode assembly. The anode assembly 42 is contiguous with the rear bulkhead 22 Referring to FIG. 1B, the anode assembly 42 comprises, proceeding from right to left, an insulator 90, an anode bus 92, a gasket 94, an anode subassembly 96 (as shown in FIGS. 1B and 6, comprising a backplate 99, a foraminous conductive metal plate anode 98, of which only a portion is shown in FIG. 1B, and compression, or stand-off, ribs 97 between the backplate 99 and foraminous metal plate anode 98), separator strips 100, gasket 102, anode frame 104, and gasket 106. All of the above components of the anode assembly 42 are essentially the same as the corresponding components of the cathode assembly 40, with small exceptions. For instance, the anode bus 92 comprises a flange 92*a* which extends to tin the view of FIG. 1B, beyond the confines of the gasket 94. A source (not shown) of current for the electrolyzer is connected to the flange 92*a*.

The anode subassembly 96 is similar to the cathode subassembly 76. The foraminous metal plate anode 98, which for convenience may sometimes be referred to herein as the "foraminous metal plate 98" or simply the "plate 98" has an active anode surface which, in the view of FIG. 1B, is the surface of plate 98 which is visible. The foraminous metal plate 98 is in front of the backplate 99, and only a portion of the foraminous metal plate 98 is shown in the view shown in FIG. 1B. The compression ribs 97, FIG. 6, as with the cathode 40, are secured, as by welding, to the backplate 99 and the foraminous metal plate 98 is fastened, e.g., welded, to the compression ribs 97. The separator strips 100, of a resilient material, are fastened to the foraminous metal plate 98, on the active anode surface side, for instance by chemical, i.e., adhesive, means or by mechanical means such as riveting. The separator strips 100 preferably align with every other one of the compression ribs 97. They also align with the separator strips 88 (FIG. 1A) of the cathode assembly 40.

As shown in FIG. 1B, the anode frame 104 defines an anolyte chamber 107. The anode frame 104 has feed and discharge manifolds 108 and 110, respectively. The manifolds 108 and 110 have manifold ports 112 and 114, respectively, for the flow of anolyte into, and product out of, the anolyte chamber 107, in a manner to be described. A lower spool 116 conveys anolyte to the manifold port 112 from the anolyte feed port 36*a* (FIG. 1A). An upper spool 118 conveys anolyte from the manifold port 114 to the anolyte discharge port 36*b* (FIG. 1A). The feed and discharge manifolds 108 and 110 also have second openings 111*a*, 111*b* aligned with the electrolyte, feed and discharge ports 38*a*, 38*b* of the feed/discharge bulkhead 12, through spools, not shown. These second openings 111*a*, 111*b* can accommodate circulation of electrolyte beyond the anode assembly 42, e.g., for use if additional cells are to be added to the cell stack.

As with the cathode assembly 40, the anode frame 104 and anode backplate 99 have holes 117 and 119, respectively, which align with and receive the shear pins 59 (FIG. 1A). The anode assembly is thus supported by the shear pins 59. Also, the anode bus 92 has holes, not shown, which align with and receive the shear pins 59 so that the anode bus 92 is also supported by the shear pins.

Returning then to FIG. 1A, the center compartment 44 comprises a frame 120. The frame 120 can be machined, as for the cathode frame 48 and the anode frame 104, and defines an electrolyte chamber 121. The center compartment frame 120 is very thin, typically having a thickness of less than about 0.1 inch, to minimize overall cell voltage. The center compartment frame 120 accommodates separator ribs 122 in the electrolyte chamber 121. The ribs 122 can have a center cross-support member (FIG. 4) and are typically narrow, elongate members usually made of a polymeric material and are inserted into divots machined into the center compartment frame 120. The ribs are nonconductive, since metal ribs might act as electrodes when current is passed through the cell, causing loss of efficiency and corrosion of the ribs. A preferred polymeric material is the hereinbefore described KYNAR, although other such materials, e.g., polyvinylchloride (PVC), and chloropolyvinyl chloride (CPVC) may be used.

The center compartment separator ribs 122 align with the compression ribs 97 and 86 of the anode and cathode assemblies, but only with such compression ribs 97 and 86 which have the overlaying separator strips 100 and 88. Thus, there are usually half as many separator ribs 122 in the center compartment 44 as metal compression ribs 86 and 97 that are part of the cathode assembly 40 and the anode assembly 42. When the entire cell is compressed between the bulkheads 12 and 22, in a manner to be described, the aligned ribs, that is the ribs 122 of the center compartment and those of the cathode and anode compartment which have the overlaying compression strips 100 and 88, transmit the compression forces through the cell.

The opposite sides of the center compartment 44 are sealed, as shown in FIG. 1A, with gaskets 124 and 126, against separators 46*a* and 46*b* (FIGS. 1A and 1B). A preferred gasket material, as with other gaskets in the electrolyzer, is the hereinbefore described Gore-Tex. Preferably, the center compartment gaskets 124 and 126, are very thin, having an uncompressed thickness generally of about 0.01 inch. These gaskets are thin to keep the gap between the electrodes as small as possible.

The center compartment gaskets 124 and 126 will usually have a width of about one inch, i.e., will be comparable in width to other cell gaskets.

As with the cathode and anode assemblies, the center compartment frame has holes 131 at the four corners of the frame which receive the shear pins 59. The center compartment frame is thus supported by the shear pins 59. The center compartment frame 120 has feed and discharge manifolds 128 and 130. The manifolds also have ports 132 and 134 which align with spools 136 and 138. The spool 136 conveys electrolyte from the electrolytic feed port 38*a* of the bulkhead 12 and the spool 138 conveys electrolyte to the electrolyte discharge port 38*b* of the bulkhead 12. The ports 132 and 134 of the center compartment 44 are manifold openings.

Figure 4:
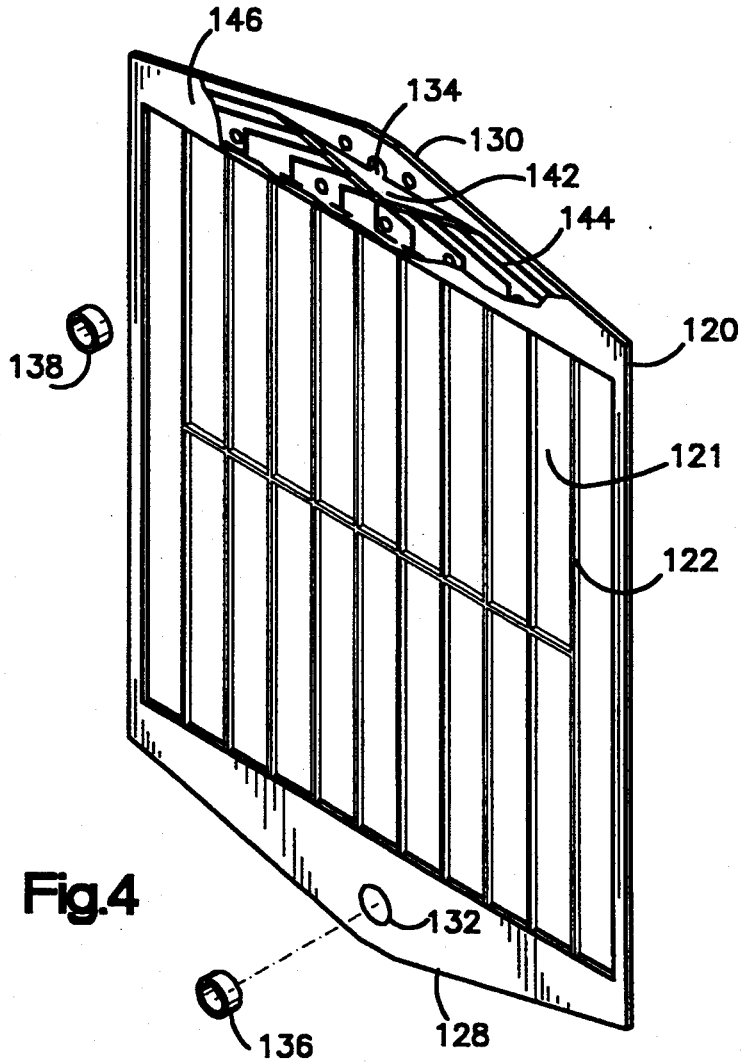
FIG. 4 is an enlarged perspective of a frame of a center compartment electrode assembly, showing a portion of the frame broken away.

FIG. 4 shows the discharge manifold 130 of the center compartment frame 120 partially cut-away. The manifold 130 is machined so that the port 134 communicates with a plenum chamber 142. A plurality of passageways 144 lead from the plenum chamber 142 to the electrolyte chamber 121. A cover plate 146 extends over the passageways 144 and plenum chamber 142 so that only the opening 134 is visible. The feed manifold 128 is similarly machined with a plenum chamber and passageways, both covered by a cover plate, so that only opening 132 is exposed to view.

Figure 7:
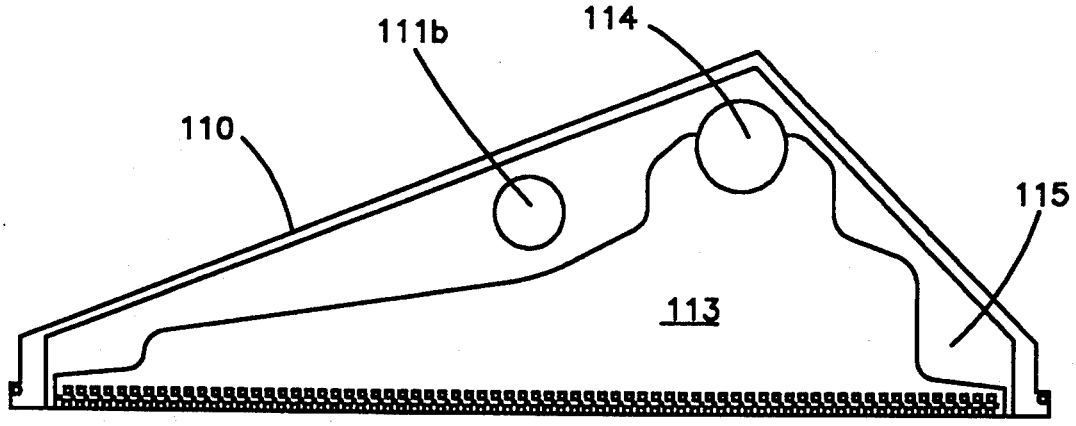
FIG. 7 is a front view of an electrode assembly
Figure 7A:
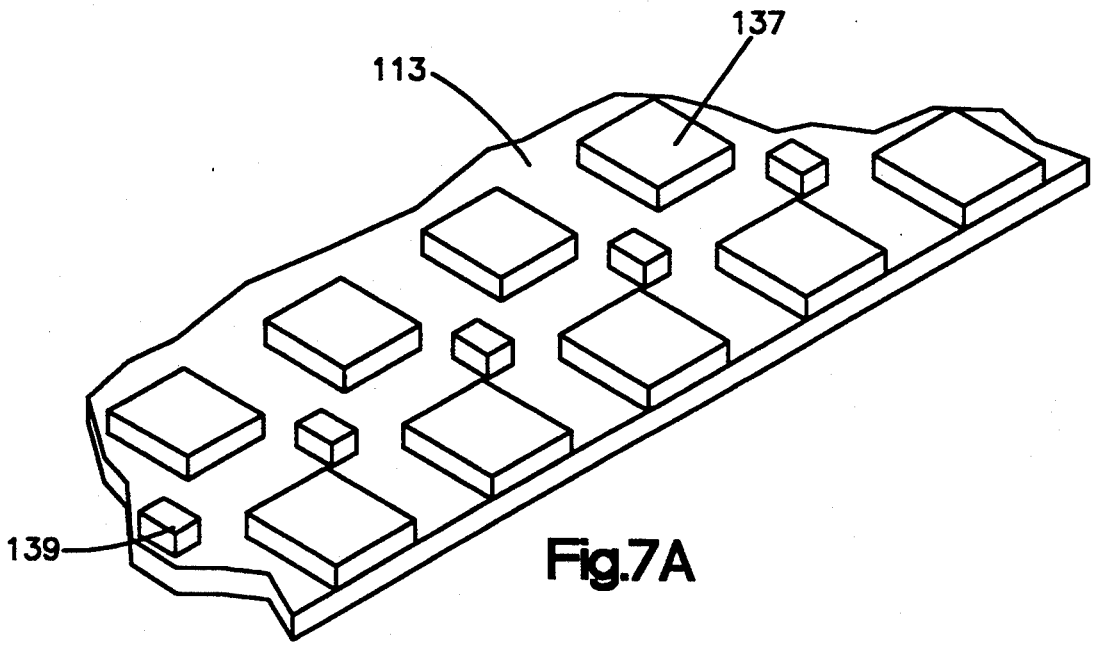
FIG. 7A is an enlarged perspective view of a portion of the fluid entry channels for the electrode assembly manifold of FIG. 7.

This construction of the center compartment frame 120 is different from in the frames 48 and 104 for the cathode assembly, and the anode assembly. A representative electrode frame, e.g., the anode frame 104, is depicted in FIG. 7. As shown in FIG. 7, the anode frame discharge manifold 110, with cover plate removed, has a manifold port 114 and a second opening 111*b*. At the generally lower section of the manifold 110 there is a plenum chamber 113 and the upper edge of the plenum 113 ends at a projecting ledge 115. Products, e.g., gas and liquid, discharging from the anolyte chamber will move through the plenum chamber 113 and be directed by the projecting ledge 115 to the manifold port 114. As will be seen in FIG. 7, product discharge from the anolyte chamber takes place along essentially the full length of the lower edge of the discharge manifold 110, e.g., along at least about 90–95% or more of this edge. This discharge enters (FIGS. 7 and 7A) at the lower edge of the discharge manifold 110 by passageways between a sequence of raised blocks 137 and knuckles 139, which are provided on, and project from, the face of the lower edge of the plenum chamber 113. These blocks 137 and knuckles 139 provide paths for products entry and serve to maintain spacing between the gasket 106 and the broad face of the plenum chamber 113. Thus the upper edge of the gasket 106 seats mainly against the outer surface of these blocks 137 and knuckles 139.

The cathode frame 48 has manifolds 52 and 54 formed in a like manner. The ports 60*a* and 60*b* communicate with plenum chambers. The plenum chambers have passageways which communicate the plenum chamber with the catholyte chamber 50. Spools 60*c* and 60*d* provide a flow of catholyte into and out of the chamber 50 through the ports 34*a* and 34*b* of the feed/discharge bulkhead 12.

Referring to FIG. 1A, the spools 136 and 138 for the center compartment fit within openings 62*a* and 62*b* of the manifolds 54, 52 of the cathode frame 48. These openings 62*a* and 62*b*, and thus the spools 136 and 138 lie outside the confines of the cell gaskets 74, 58, 89, and 124. In this way the electrolyte feed to the center compartment electrolyte chamber 121 is caused to bypass the catholyte chamber 50.

It should be noted that because of the way the manifolds 108, 110 (FIG. 1B) of the anode frame 104 are configured (each with an apex off-center to the right in the view of FIG. 1B), compared to the center compartment frame 120 (FIG. 1A) (wherein the apex of each manifold 128, 130 is centered), the spools 116, 118 (FIG. 1B) for the anolyte bypass the center compartment frame. These spools also bypass the cathode frame 48 (FIG. 1A) (wherein the apex of each manifold 52, 54 is off-center to the left, in the view of FIG. 1A).

To assemble the electrolyzer of the present invention, the cathode assembly 40 (FIG. 1A) is first assembled and placed against the feed/discharge bulkhead 12, the assembly being aligned and located by the shear pins 59. The center compartment assembly 44 is then assembled, with separators 46*a* and 46*b*, and properly located with the shear pins 59 in a stacked relationship with the cathode assembly 40. The anode assembly 42 is then assembled, placed in a stacked relationship, and located by the shear pins 59 in alignment with the cathode assembly 40 and center compartment assembly 44, and the entire assemblies are placed against and between the bulkheads 12 and 22. The respective components are all provided with close fits and tolerances so that they are all in accurate alignment. The tie rods 30 are then inserted through the members of the assemblies and tightened to draw the bulkheads together compressing the assemblies between the bulkheads. In tightening down the tie rods 30, the tie rods function primarily to compress the gaskets (going from left to right in FIGS. 1A and 1B) 74, 58, 89, 124, 126, 106, 102, and 94 of the assemblies, sealing the catholyte chamber 50, the center compartment chamber 121, and the anolyte chamber 107. The tightening will also serve to compress gaskets, all not shown, utilized to seal the feed and discharge flow paths, e.g., gasketing for the spools, in the cathode assembly 40, anode assembly 42 and center compartment assembly 44. Furthermore, to seal these flow paths at the rear bulkhead 22 there can be used end stops such as the end stops 24*a*, 24*b* and 24*c* (FIG. 1B) on the rear bulkhead inner plate 24.

As shown in FIG. 1A, compression jack screws 150 can be threaded into the support frame 16 of the feed/discharge bulkhead 12 and when turned bear against the inner plate member 14, causing it to adopt a concave configuration toward the center of the electrolyzer. This concave configuration and the forces exerted thereby, are transmitted through the current distributing buses 72 and 92, and through the cathode subassembly 76 and anode subassembly 96. They are transmitted through the cathode subassembly 76 via the stand-off ribs 86, which have resilient separator strips 88. They are transmitted through the anode subassembly 96 via the stand-off ribs 97, which have separator strips 100. These compressive forces exerted by the strips 88 and 100 are absorbed by the ribs 122 of the center compartment frame 120. At the rear bulkhead 22 compression pins are aligned with, and preferably in the same pattern as, the jack screws 150 of the feed/discharge bulkhead 12. These compression pins are secured as by welding, to the rear compression frame 26 and transmit the compressive forces of the jack screws 150 into the frame 26, which transmits the load to the tension rods 18. It will be understood that the compressive forces will also cause the rear bulkhead inner plate 24 to adopt a concave configuration, as seen from the center of the electrolyzer. The compression establishes a desirable, dry electrical connection between the cathode and anode distributing buses and the cathode and anode backplate, respectively, with minimal gaps, e.g., equal to the thickness of the center compartment ribs 122, or the small finite gaps of the cathode and anode compartments without shorting the cell or establishing other than the desired current flow paths.

The present invention is particularly useful for the efficient electrolysis to recover acid and base values, e.g., electrolysis of a waste sulfate stream. With an electrolyte as represented by an aqueous waste sulfate stream, the sulfate solution is continuously circulated through the center compartment electrolyte chamber 121. This current flow through the sulfate solution causes the cations to migrate from the center compartment chamber 121 through an ion exchange membrane **46*a* to the catholyte, which for this representative illustration can be dilute sodium hydroxide. Anions migrate from the center compartment chamber 121 through an ion exchange membrane 46*b* to the anolyte, which can be dilute sulfuric acid. In this electrolysis, a more concentrated catholyte and anolyte can then be recovered at discharge ports 34*b* and 36*b* of the bulkhead 12**.

The present invention is particularly useful in operations where electrodes need to be removed and refurbished. For example, in many electrolyte operations, electrodes can be used that contain coatings which need to be repeatedly replaced or refreshed, often before a need for replacement of other cell parts. With the present invention, in electrolyzer disassembly, the cathode assembly 76, for example, is readily separable as a unit, even from the cathode frame 48. This assembly 76 of compression ribs 86, backplace 84 and cathode 80 can then form a unit for refurbishing. If separator strips 88 are present on the cathode, they may be removed. This will be the case, for example, where electrode coating will include an elevated temperature treatment, as in the baking of an applied fresh coating, which baking could damage resilient, polymeric strips 88. With strips 88 removed, the assembly will be an all metal assembly. It is contemplated that the assembly can often remain intact while the electrode is being refurbished. Upon completion, the assembly need only have separator strips 88 replaced and is then ready for reassembly into an electrolyzer.

Figure 2:
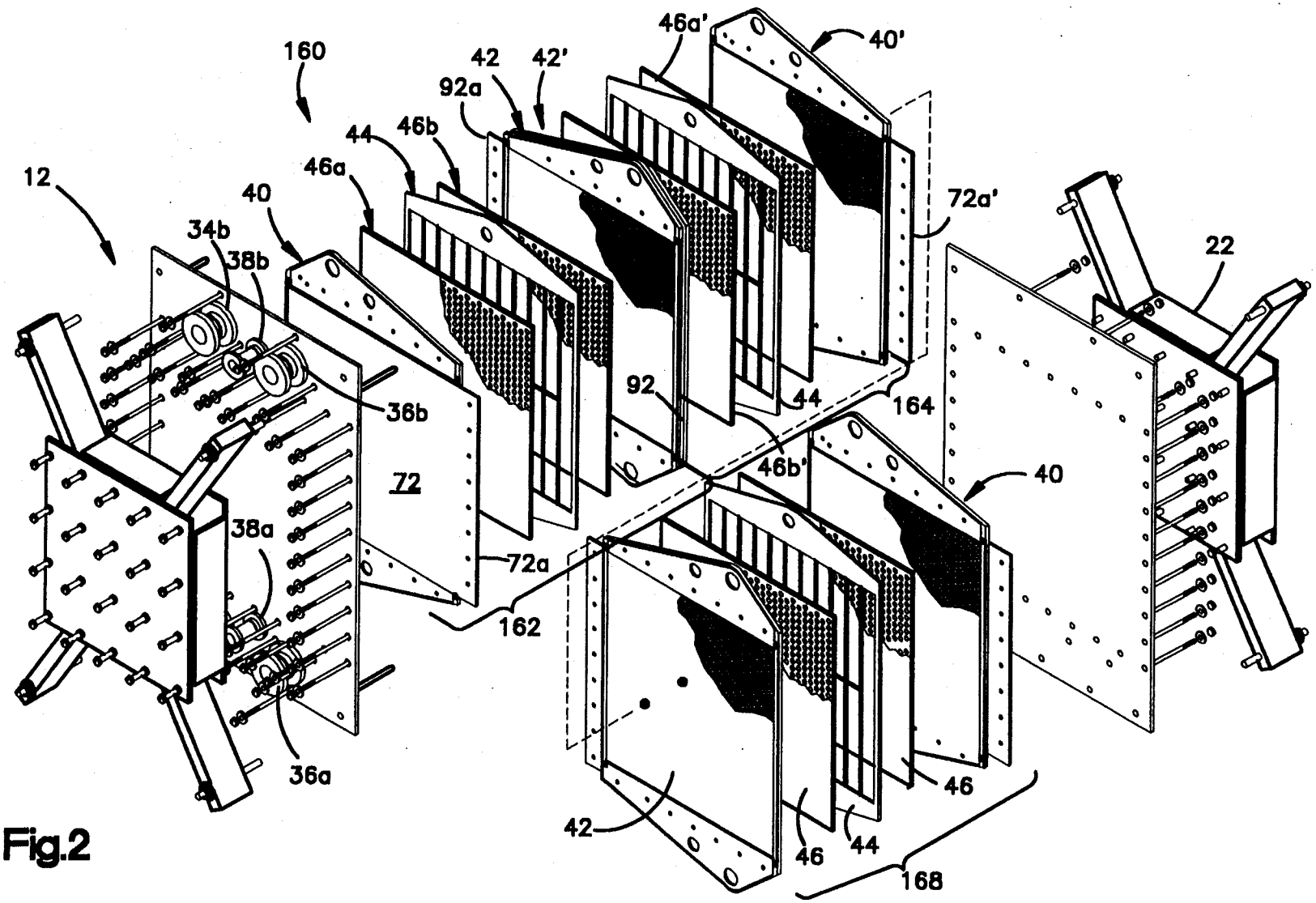
FIG. 2 is an exploded perspective view of an electrolyzer similar to the electrolyzer of FIG. 1 showing multiple three-compartment monopolar electrolytic cells.

A multi-cell monopolar electrolyzer 160 of the present invention is shown in FIG. 2. The electrolyzer 160 comprises a feed/discharge bulkhead 12 and a rear bulkhead 22. The electrolyzer includes, proceeding from the feed/discharge bulkhead 12 to the rear bulkhead 22, a first cell 162. The first cell 162 includes a cathode assembly 40, comprising the components thereof disclosed with respect to FIG. 1A, a first separator **46*a*, a center compartment assembly 44 having the components thereof described with respect to FIG. 1A, a second separator 46*b*, and an anode assembly 42, having the components thereof described with respect to FIG. 1B**.

The sequence of the first cell 162 is repeated, but in reverse order, to assemble a second cell 164, in stacked relationship with the first cell 162. The second cell 164 starts with a second anode assembly 42'. The anode assembly 42 of the first cell and the anode assembly 42' of the second cell are separated by an anode bus 92 having a flange **92*a*. Continuing then, the second cell 164 has a separator 46*b'*, a center compartment assembly 44' and a separator 46*a'*. The second cell 164 then ends at the cathode assembly 40' plus a second cathode bus (not shown) having a cathode flange 72*a'*. If the electrolyzer is two cells only, namely cells 162, 164, it is understood that the electrolyzer ends at the second cathode bus and flange 72*a'*. In the figure, for purposes of further illustration, the second cell 164 is connected by a dashed/dotted line to a third cell 168**. The dashed/dotted line indicates the presence of additional components.

If the electrolyzer comprises more than three cells, e.g., ten to twenty cells, it is understood that the dashed/dotted line represents additional cells starting with the cathode assembly (not shown) and ending with an anode bus (not shown) for the anode 42 of the third cell 168. As with cells 162, 164, each cell includes anode and cathode assemblies and a separator/center compartment assembly, all similar to the three cells shown in the figure.

FIG. 2 shows, adjacent to the rear bulkhead 22, the third cell 168 which includes, in the drawing of FIG. 2, a cathode assembly 40, a separator/center compartment assembly 46, 44 and 46 and an anode assembly 42. In this embodiment of FIG. 2, this is a convenient way to terminate the cell stack. However, the cell stack might, in some arrangements, be terminated with an anode assembly.

Figure 2A:
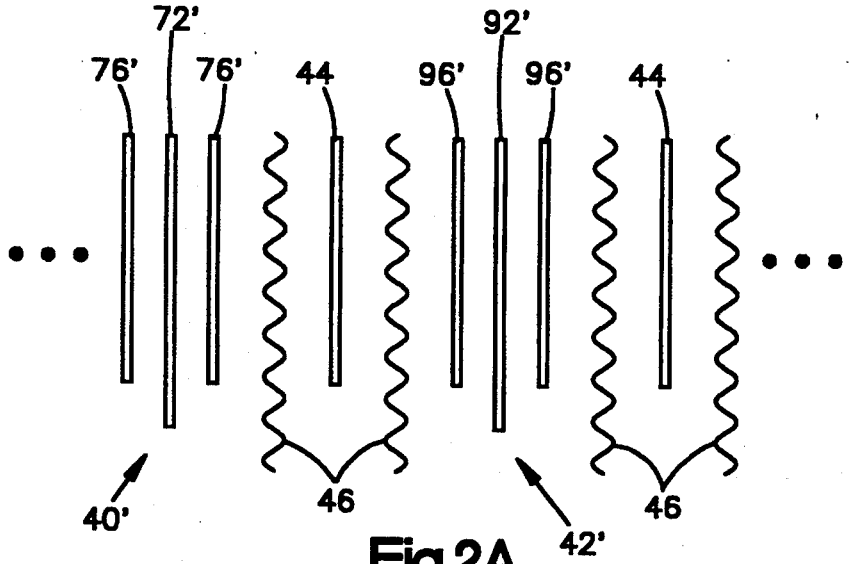
FIG. 2A is a schematic, exploded, plan view illustrating the arrangement of component parts of a portion of the electrolyzer of FIG. 2.

In the electrolyzer of FIG. 2, the cell or cells, which constitute the middle portion of the electrolyzer, are arranged in a monopolar fashion. This arrangement for these middle cells is more particularly depicted in FIG. 2A. In these cells the mid-cell cathode assembly 40' comprises, as shown in FIG. 2A, a central cathode bus 72' and side cathodes 76' on opposite sides of the bus 72'. It is understood that each side cathode 76', in this instance, comprises a cathode subassembly (a foraminous metal plate cathode, a backplate, and compression ribs between the foraminous metal plate and backplate) as well as separator strips plus cathode frame, and sealing gaskets for the cathode frame. The first side cathode 76', going from left to right in FIG. 2A is arranged with its backplate against the bus 72'. The second side cathode 76' faces the opposite direction as the first side cathode and also has its backplate against the bus 72'. The second side cathode subassembly separator strips separate the foraminous metal plate of the subassembly from a separator 46. The separators 46 are positioned on each side of a center compartment assembly 44. Similarly, the anode assembly 42' is arranged in a monopolar fashion, as shown in FIG. 2A, with a central anode bus 92' and side anodes 96' on opposite sides of the bus 92'. Each side anode 96' comprises an anode subassembly (a foraminous metal plate anode, a backplate, and compression ribs between the foraminous metal plate and backplate), as well as separator strips, plus anode frame and sealing gaskets for the anode frame. Both side anodes 96' are arranged with their backplates against the bus 92' and the foraminous metal plates face in opposite directions. The foraminous metal plates of both side anodes 96' face separators 46, which are adjacent center compartment assemblies 44, but the foraminous metal plates are separated from the separators by separator strips as in the embodiment of FIGS. 1 and 2.

In the embodiment of FIG. 2, the distributor bus 72 of the first cathode assembly 40 has a flange **72*a* which projects from the cell 162 to the right. The second cell 164 and all of the remaining cells can also have cathode distributor bus flanges projecting to the right, e.g., the flange 72*a'***. This arrangement of the cathode distributor buses of the electrolyzer permits all of these cathode distributor buses to be easily connected together, by an external cathode bus, not shown.

Similarly, all of the anode assemblies, in the embodiment of FIG. 2, have distributor bus flanges 92a (as shown for cells 162, 164) projecting to the left from the electrolyzer. This permits all of the distributor buses of the electrolyzer, for the anodes, to be easily connected together by an external anode bus, also not shown.

In the monopolar electrolyzer of FIG. 2, electrolyte is circulated to all of the center compartments 44 of each cell. A similar flow arrangement accommodates catholyte circulation for all of the catholyte compartments and anolyte circulation for all of the anolyte compartments. Because of the arrangement of cells and center compartments, feed of electrolyte occurs in each center compartment assembly with migration of cations to the catholyte and anions to the anolyte.

Figure 3:
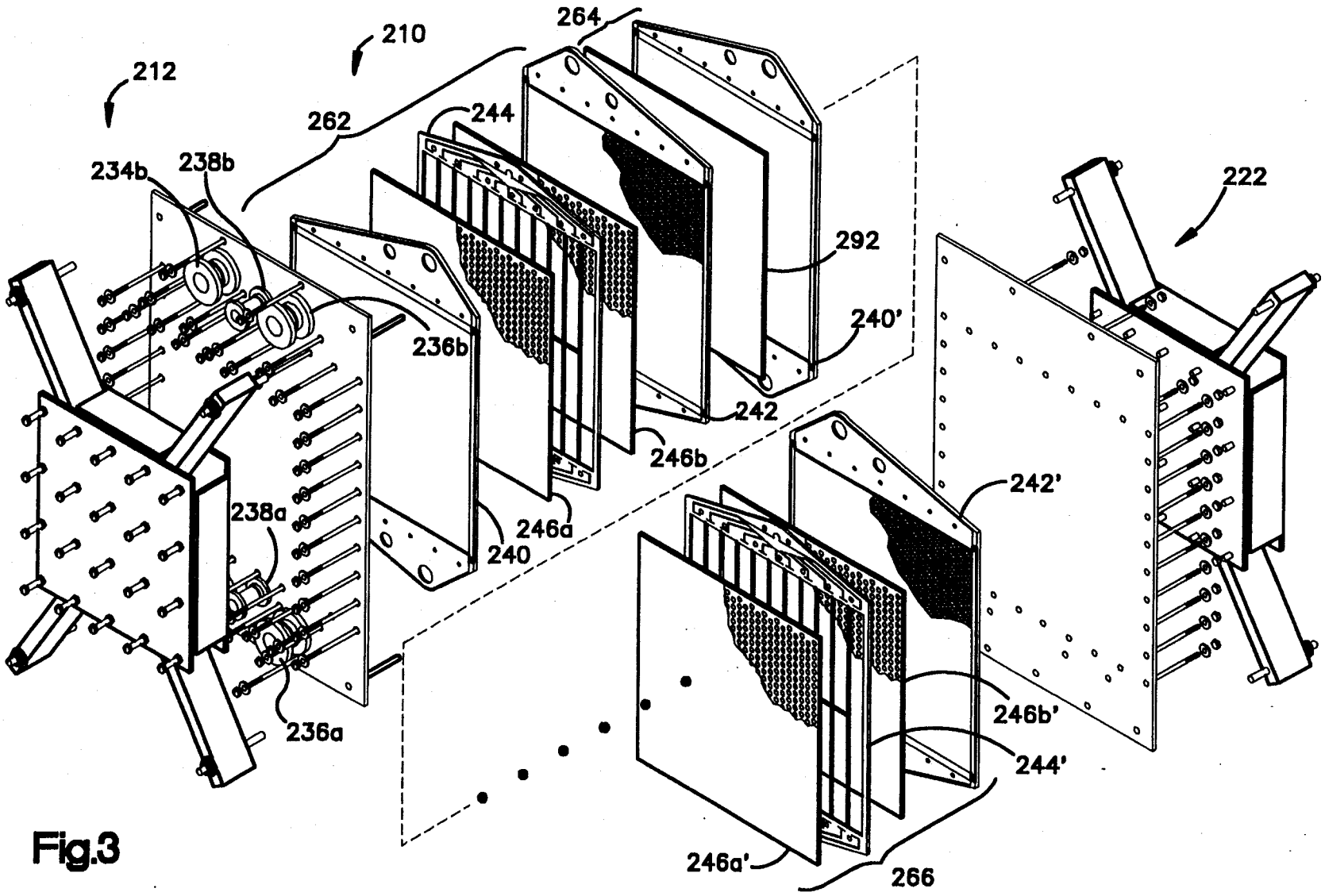
FIG. 3 is an exploded perspective view of an electrolyzer in accordance with the present invention showing multiple three-compartment bipolar electrolytic cells.

FIG. 3 shows a bipolar multi-cell electrolyzer 210 in accordance with the concepts of the present invention. The electrolyzer 210 comprises a feed/discharge bulkhead 212 and a rear bulkhead 222. The electrolyzer also includes, proceeding from the feed/discharge bulkhead 212 to the rear bulkhead 222, a first cell 262. The first cell 262 includes a cathode assembly 240, comprising essentially the same components disclosed with respect to FIG. 1A, e.g., having an insulator and cathode distributor bus (not shown) like the insulator 70 and bus 72 of FIG. 1A. The electrolyzer of FIG. 3 then bus, from front to back, a first separator 246a, a center compartment assembly 244, having essentially the same components described with respect to FIG. 1A, a second separator 246b, and an anode assembly 242, having the same components described with respect to FIG. 1B.

The sequence of the first cell 262 is repeated in a second cell 264, in stacked relationship with the first cell 262. The electrolyzer does have a bus 292 between cells for good transport of electricity from one cell to the next. The second cell 264 starts with a second cathode assembly 240'. The second cathode assembly 240' is connected by a dashed/dotted line to a grouping 266 which includes a separator 246a', a center compartment assembly 244', a second separator 246b' and an anode assembly 242'. The anode assembly 242', will comprise an insulator and anode bus (not shown) like the insulator 90 and anode bus 92 for the anode assembly 42 of FIG. 1B. It is understood that as with the multi-cell monopolar electrolyzer of FIG. 2, the dashed/dotted line can represent a large number of components, illustrating an electrolyzer with three or more cells. Alternatively, the electrolyzer can comprise only two cells. In such case, the dashed/dotted line represents no additional components.

In the bipolar electrolyzer of FIG. 3, the cells and components thereof are electrically connected internally, requiring only the cathode distributor bus (not shown) for the first cell cathode assembly 240 and an anode bus (not shown) for the final anode assembly 242'. Current flows from each cathode through a center compartment to the anode, and then to the cathode of the next cell, through the center compartment of that cell to the anode, and so forth. The major difference between the electrolyzer of FIG. 2 and the electrolyzer of FIG. 3 is that in the electrolyzer of FIG. 3, there are only the first cell and last cell bus connections. In other respects, e.g., the means for circulation of anolyte, catholyte, and electrolyte, the cells of FIGS. 2 and 3 are quite similar. The result is that the components of the electrolyzer can be standardized and readily adapted for making a monopolar cell or a bipolar cell, or making an electrolyzer of any number of cells, thus offering economies of production. As with the electrolyzer of FIG. 2, the electrolyzer of FIG. 3 can comprise any number of cells, by way of example, ten to twenty cells.

The active electrode surface area of the cathodes and anodes of the electrolyzers of the present invention may comprise a foraminous surface of a type which is generally known in the art. The active surface can be uncoated, e.g., a bare, smooth nickel metal anode for water electrolysis. Alternatively, the active surface such as for the anodes 98 can comprise a coated metal surface, such as a valve metal substrate having an electrocatalytic coating applied thereto. The coating can be a precious metal and/or oxides thereof, a transition metal oxide and mixtures of any of these materials. Any foraminous material can be used. An expanded metal mesh as indicated is preferred. The electrode can be, however, a perforated plate or wire screening. It is understood that this foraminous material has a high surface area and a large number of points of contact with the separators, which may be brought about by having a large number of small perforations. One specific reticulated electrode is a titanium metal substrate coated with an electrocatalytic coating which is dimensionally stable, such as described in U.S. Pat. No. 4,517,069. This disclosure of this patent is incorporated by reference herein. The electrode is electrically attached, as well as otherwise secured, to the ribs, for instance by welding. When welding is used, it may take the form of resistance welding, tungsten inert gas welding, electron beam welding, diffusion welding, and laser welding, by way of example.

The anodes and cathodes have been described in their relationship to the preferred embodiment of the invention as providing a finite separator gap, it being understood that the present invention encompasses finite gap cells which are well known and understood in the art. Although the general cell configurations as depicted in the figures haves been shown to be square shaped, it will be understood that other shapes may be suitable for the electrolyzer, e.g., oval, circular or rectangular. All plates, rods, pins and the like, when made of metal, will be understood to be typically made of such metals as steel, nickel or titanium, unless otherwise specified as with the copper or aluminum busses. Also, metals are meant to include alloys and intermetallic mixtures. The frames, in addition to being of a chemically resistant metal, can be of alternate materials, such as polymeric materials. For instance, the frames may be molded of a suitable corrosion resistant polymeric material such as Kynar, CPVC, the hereinbefore described Teflon, acrylonitrile-butadiene-styrene resin (ABS) and polypropylene.

Membranes suitable for use as separators in the instant invention are of several types which are commercially available. One presently preferred material is a perfluorinated copolymer having pendant cation exchange functional groups. These perfluorocarbons are a copolymer of at least two monomers with one monomer being selected from a group including vinyl fluoride, hexafluoropropylene, vinylidine fluoride, trifluoroethylene, chlorotrifluoroethylene, perfluoro (alkylvinyl ether), tetrafluoroethylene, and mixtures thereof.

The second monomer often is selected from a group of monomers usually containing an $SO_2F$ or sulfonyl fluoride pendent group. Examples of such second monomers can be generically represented by the formula $CF_2=CFR_1SO_2F$. $R_1$ in the generic formula is a bifunctional perfluorinated radical comprising generally one to eight carbon atoms-but upon occasion as many as twenty-five. One restraint upon the generic formula is a general requirement for the presence of at least one fluorine atom on the carbon atom adjacent the $—SO_2F$ group, particularly where the functional group exists as the $—(—SO_2NH)mQ$ form. In this form, Q can be hydrogen or an alkali or alkaline earth metal cation and m is the valence of Q. The $R_1$ generic formula portion can be of any suitable or conventional configuration, but it has been found preferably that the vinyl radical comonomer join the $R_1$ group through an ether linkage.

Such perfluorocarbons, generally are available commercially, such as through E. I. duPont, their products being known generally under the trademark NAFION. Perfluorocarbon copolymers containing perfluoro (3,6-dioxa-4-methyl-7-octenesulfonyl fluoride) comonomer have found particular acceptance. Membranes having anion exchange properties can also be suitably utilized, as between an anode and a cell center compartment.

Where the separator is a porous diaphragm, a number of well known diaphragm materials can be employed. A preferred porous diaphragm is one typically made of fluorinated polymer fibers and contains embedded particulates such as a zirconia, which material is available from the assignee of the present application under the trademark ELRAMIX. Other serviceable diaphragms can be made of polyvinylidene fluoride (PVDF). One suitable PVDF diaphragm is marketed by Porex Technologies Corp. under the trademark POREX. Another is marketed by Pennwalt Corp. under the trademark KYNAR and one is marketed by Millipore Corporation under the trademark DURAPORE. Examples of other suitable diaphragm materials are polytetrafuorethylene (PTFE), fiberglass, polyvinyl chloride (PVC), styrene-acrylonitrile, and ceramics. Porous PTFE diaphragms are commercially available from Microporous Products Division of Amerace Corporation under the trademark "AMERSIL" from Millipore Corporation under the trademark "FLUOROGARD", and from Norton Company under the trademark "ZITEX". As will be understood, membranes may be used for each of the separators at the center compartment, such as one cation exchange and one anion exchange membrane. Or in some instances, one membrane and one diaphragm may be advantageous, such as a diaphragm to replace an anion exchange membrane, although other combinations are contemplated.

Having described the invention, the following is claimed:

1. A filter press electrolyzer comprising:
(a) a front bulkhead;
(b) a rear bulkhead;
(c) a pair of electrode assemblies in a stacked relationship between said bulkheads;
(d) a separator clamped between said electrode assemblies;
(e) each electrode assembly comprising:
(i) an annular frame defining an electrolyte chamber;
(ii) a planar electrode having an electrode active surface area within said chamber;
(iii) a solid metal backplate facing said electrode;
(iv) a plurality of long and narrow non-compressed metal stand-off ribs positioned parallel to each other, the ribs projecting from the backplate to the planar electrode; and
(v) a current distributing bus positioned against a planar face of said backplate which is opposite a planar face of said backplate facing said electrode, said bus having a planar surface which is substantially co-extensive with said electrode active surface area;
(f) a plurality of spaced-apart, long and narrow separator strips affixed to a planar face of said electrode on the face thereof opposite to the current distributing bus, said separator strips separating the electrode from said separator;
(g) said bulkheads including means for compression of said electrode assemblies one towards the other, said separator strips transmitting the compression forces within the electrolyzer from one electrode assembly to the other.

2. The electrolyzer of claim 1, wherein each electrode comprises a planar foraminous member having an active electrode area, said metal stand-off ribs are positioned between the backplate and the foraminous member, and said separator strips are aligned with every other one of the stand-off ribs, with the backplate pressed into intimate contact with the current distributing bus by the compression forces within the electrolyzer.

3. The electrolyzer of claim 2, wherein the metal stand-off ribs are secured to the backplate and the foraminous member.

4. The electrolyzer of claim 2, wherein one of said electrodes is a cathode and the other of said electrodes is an anode having a configuration similar to the cathode.

5. The electrolyzer of claim 2, wherein the separator strips are of a non-conductive polymeric material.

6. The electrolyzer of claim 2, wherein said foraminous member is reticulate expanded metal, and said foraminous member and backplate define opposite sides of said electrolyte chamber.

7. The electrolyzer of claim 6, wherein said stand-off ribs are secured to the backplate and said foraminous member is secured to the stand-off ribs.

8. The electrolyzer of claim 2, wherein the peripheral dimensions of said backplate exceed the peripheral dimensions of said foraminous member.

9. The electrolyzer of claim 1, wherein said separator is a membrane or a diaphragm.

10. The electrolyzer of claim 1, wherein said separator is clamped between the annular frames of said electrode assemblies.

11. The electrolyzer of claim 1, in the form of a three-compartment cell, including a center compartment assembly between and in stacked relationship with said pair of electrode assemblies, said center compartment assembly including an annular frame defining an electrolyte chamber, said center compartment assembly including ribs within said electrolyte chamber aligned with the separator strips of the pair of electrode assemblies to transmit said compression forces from one electrode assembly to the other.

12. The electrolyzer of claim 11, wherein one of said electrode assemblies is a cathode assembly including a catholyte chamber, and the other of said electrode assemblies is an anode assembly including an anolyte chamber, said electrolyzer further including:
(a) a first separator between the catholyte chamber and the center compartment electrolyte chamber;

(b) a second separator between the anolyte chamber and the center compartment electrolyte chamber;
(c) means to circulate electrolyte through said center compartment electrolyte chamber;
(d) means to circulate catholyte through said catholyte chamber; and
(e) means to circulate anolyte through said anolyte chamber.

13. The electrolyzer of claim 11, wherein said ribs have a cross-support member.

14. The electrolyzer of claim 1, wherein each of said bulkheads comprises a deformable planar member including means to exert a force on each deformable planar member to force them into a slightly concave configuration one towards the other, whereby they exert a compressive force on the electrode assemblies.

15. The electrolyzer of claim 14, wherein each of said bulkheads is a dual bulkhead assembly including inner and outer bulkhead members, said inner bulkhead member being said deformable planar member and being adjacent an electrode assembly, said outer bulkhead member being rigid, each bulkhead assembly including adjustable means between the bulkheads to force the inner bulkhead member into said slightly concave configuration.

16. In a filter press electrolyzer having a front bulkhead, a rear bulkhead, and an electrode assembly between said bulkheads, wherein the improvement comprises at least one bulkhead being a dual bulkhead assembly including separate inner and outer bulkhead members, said inner bulkhead member being a deformable planar member and being adjacent said electrode assembly, said outer bulkhead member being rigid and displaced from said electrode assembly by said inner bulkhead member, said bulkheads including adjustable means between the bulkheads to deform said inner bulkhead member into non-planar, concave configuration toward said electrode assembly.

17. The electrolyzer of claim 16, wherein each bulkhead has a dual bulkhead assembly.

18. In a filter press electrolyzer having a front bulkhead, a rear bulkhead, and an electrode assembly between said bulkheads, wherein the improvement comprises said electrode assembly having:
(a) a planar foraminous electrode having an active electrode area;
(b) a solid metal backplate;
(c) a plurality of spaced-apart, long and narrow, non-compressed metal stand-off ribs between the backplate and the foraminous electrode; and
(d) a plurality of spaced-apart, long and narrow separator strips on a side of said electrode opposite to the metal plate and affixed to a planar face of said electrode;
with said separator strips being fewer in number than, but in alignment with, said stand-off ribs.

19. The electrolyzer of claim 18, wherein the metal stand-off ribs are secured to both the backplate and the foraminous electrode.

20. The electrolyzer of claim 18, wherein said stand-off ribs are positioned parallel to each other.

21. The electrolyzer of claim 18, wherein the separator strips are secured to said foraminous electrode and are of a non-conductive polymeric material.

22. The electrolyzer of claim 18, wherein the separator strips are aligned with every other one of the stand-off ribs and separate the electrode from a separator.

23. The electrolyzer of claim 18, wherein said foraminous electrode is reticulate expanded metal, and said electrode and backplate define opposite sides of an electrolyte chamber.

24. The electrolyzer of claim 18, wherein said backplate is adjacent a current distributing bus and is pressed into intimate contact with the current distributing bus by compression forces transmitted through the electrolyzer.

25. The electrolyzer of claim 18, having more than one electrode assembly with each electrode assembly having metal stand-off ribs which are aligned with the stand-off ribs of the other electrode assemblies.

26. The electrolyzer of claim 18, having more than one electrode assembly with each electrode assembly having non-conductive separator strips which are aligned with the separator strips of the other electrode assemblies.

27. The electrolyzer of claim 18, further comprising a center compartment assembly between electrode assemblies, said center compartment assembly having separator ribs in an electrolyte chamber, which ribs are in alignment with said stand-off ribs of said electrode assembly.

28. The electrolyzer of claim 27, wherein said separator ribs have a cross-support member.

29. A filter press electrolyzer comprising:
(a) a front bulkhead;
(b) a rear bulkhead;
(c) at least one pair of electrode assemblies in a stacked relationship between said bulkheads, with each electrode assembly comprising:
(i) a planar electrode having an active electrode area;
(ii) a solid metal backplate; and
(iii) a plurality of spaced-apart non-compressed metal stand-off ribs between the backplate and the planar electrode; and with said electrolyzer also comprising
(d) a center compartment assembly between and in stacked relationship with said pair of electrode assemblies, said center compartment assembly including:
(i) an electrolyte chamber; and
(ii) ribs within said electrolyte chamber aligned with the stand-off ribs of said electrode assemblies to transmit compression forces from one electrode assembly to the other.

30. The electrolyzer of claim 29, wherein said ribs within said electrolyte chamber have a cross-support member.

31. A filter press electrolyzer having electrode assemblies in a stacked relationship between bulkheads, said electrode assemblies comprising a planar electrode member and an electrolyte chamber plus a discharge manifold which is positioned adjacent said electrolyte chamber and has a long manifold edge along at least one edge of said electrode member, which manifold has discharge passageways along essentially the full length of said long manifold edge for entry of products from said electrolyte chamber into said manifold, said passageways being also present along essentially the full length of said electrode member edge.

32. The electrolyzer of claim 31, wherein said passageways extend along at least about 90% of the length of said edge.

33. In an electrode assembly for a filter press electrolyzer, which electrolyzer has a front bulkhead, a rear bulkhead, and said electrode assembly between said bulkheads, wherein the improvement comprises said electrode assembly having:

(a) a planar foraminous electrode having an active electrode area;

(b) a planar, solid metal backplate; and (c) a plurality of spaced-apart, narrow and elongate, electrically conductive, non-compressed metal stand off-ribs positioned parallel to each other, between the backplate and the foraminous electrode and firmly secured to both said metal backplate and foraminous electrode, with their being a plurality of spaced-apart separator strips on the side of said electrode opposite to the metal backplate, with said separator strips being in alignment with said stand-off ribs.

34. The electrode assembly of claim 33, wherein the metal stand-off ribs are welded to a face of said planar foraminous electrode and to a face of said planar metal backplate.

35. The electrode assembly of claim 33, wherein said foraminous electrode is reticulate expanded metal, and said electrode and backplate define opposite sides of an electrolyte chamber.

36. The electrode assembly of claim 33, wherein said backplate is adjacent a current distributing bus and is pressed into intimate contact with the current distributing bus by compression forces transmitted through the electrolyzer.

37. The electrode assembly of claim 33, wherein said electrolyzer has more than one electrode assembly with each electrode assembly having metal stand-off ribs which are aligned with the stand-off ribs of the other electrode assemblies.

38. The electrode assembly of claim 33, wherein said plurality of spaced-apart separator strips on the side of said electrode opposite to the metal backplate are fewer in number than said stand-off ribs.

39. The electrode assembly of claim 33, wherein said assembly is contained in an electrode frame and is readily separable from said frame.

* * * * *